United States Patent [19]

Parker

[11] Patent Number: 4,911,669

[45] Date of Patent: Mar. 27, 1990

[54] TOY SIMULATED EXPLODING VEHICLE

[75] Inventor: Kenneth G. Parker, Williamsville, N.Y.

[73] Assignee: The Quaker Oats Company, Chicago, Ill.

[21] Appl. No.: 348,610

[22] Filed: May 8, 1989

Related U.S. Application Data

[63] Continuation-in-part of Ser. No. 255,369, Oct. 11, 1988, abandoned.

[51] Int. Cl.[4] ..... A63H 17/02

[52] U.S. Cl. ..... 446/6; 446/484; 446/441; 446/435

[58] Field of Search ..... 446/6, 4, 435, 484, 446/462, 442, 441

[56] References Cited

U.S. PATENT DOCUMENTS

| | | | |
|---|---|---|---|
| 1,363,891 | 12/1920 | Lovington | 446/6 |
| 2,757,482 | 8/1956 | Brown et al. | 446/6 |
| 3,000,137 | 9/1961 | Vine | 446/6 |
| 3,479,474 | 11/1969 | Pajak | 446/442 X |
| 3,734,500 | 5/1973 | Cooper | 446/6 X |
| 3,859,752 | 1/1975 | Morrison et al. | 446/6 |
| 3,959,920 | 6/1976 | Ieda | 446/6 |

FOREIGN PATENT DOCUMENTS

| | | | |
|---|---|---|---|
| 991098 | 10/1951 | France | 446/6 |
| 2067904 | 8/1981 | United Kingdom | 446/6 |

*Primary Examiner*—Mickey Yu
*Attorney, Agent, or Firm*—Cumpston & Shaw

[57] ABSTRACT

A toy simulated exploding vehicle is disclosed including a chassis having a front end and a rear end, and an ejector seat mounted on the chassis and movable between a normal tensioned position in which it supports a simulated driver in a driving position, and an ejecting position in which it ejects the driver from the seat. A rear bumper has an integral laterally extending plate-like member slidably mounted on the chassis for reciprocal movement of the rear bumper and plate-like member as a unit between first and second positions. The plate-like member has a free end thereof extending past the front end or bumper of the chassis. A latch is provided coupling the ejector seat to the plate-like member in a third position of the rear bumper and plate-like member. In this third position the ejector seat is releasably latched in its normal tensioned position. Movement of the rear bumper and plate-like member from the third position to one of the first and second positions releases the latch member causing the ejector seat to slam a front body member open and to eject the driver therethrough.

8 Claims, 4 Drawing Sheets

TOY SIMULATED EXPLODING VEHICLE

CROSS REFERENCE TO RELATED APPLICATIONS

This is a continuation-in-part of U.S. application Ser. No. 07/255,369 entitled Toy Simulated Exploding Vehicle filed Oct. 11, 1988, abandoned.

FIELD OF THE INVENTION

The present invention relates generally to a toy vehicle, and more specifically to a toy simulated exploding vehicle.

BACKGROUND OF THE INVENTION

Children tend to spend a considerable amount of their time indulging in the world of play, fantasy, and make-believe. To indulge them, the toy industry is challenged to provide action toys that can produce new, more entertaining, or more interesting action. This invention is a realization of an attempt to make the action of a toy vehicle more entertaining, interesting, and amusing to children.

SUMMARY OF THE INVENTION

An object of this invention is to provide a toy simulated exploding vehicle that is adapted to eject the driver from the seat, and to slam the front body to an open position. The vehicle comprises:

a chassis having a front end and a rear end;

an ejector seat mounted on the chassis and movable between a normal tensioned position in which it supports a simulated driver in a driving position, and an ejecting position in which it ejects the driver from the seat;

a rear bumper having a laterally extending plate-like member slidably mounted on the chassis for reciprocal movement of the rear bumper and plate-like member as a unit, between first and second positions, the plate-like member having a free end thereof extending past the front end of the chassis; and latch means coupling the ejector seat to the plate-like member in a third position of the rear bumper and plate-like member, which is interposed between the first and second positions, for releasably latching the ejector seat in its normal tensioned position, whereby movement of the rear bumper and plate-like member from the third position to one of the first and second positions releases the latch means for ejecting the driver.

Another object of the invention is to provide the vehicle with a front body releasably mounted on the chassis, the front body further having a cam member mounted on the inner surface thereof. Accordingly, movement of the ejector seat to its ejecting position causes a part of the ejector seat to strike the cam member and slam the front body to an open position as the driver is ejected between the chassis and the front body.

Another specific object of the invention is to pivotally mount the ejector seat and front body to the chassis. The pivot for the ejector seat is located adjacent the front wheels of the vehicle, and the pivot for the front body is located adjacent the rear wheels.

A further object of the invention is to provide the vehicle with disabling means for disabling the rear bumper and plate-like member, so that it cannot be moved to one of the first and second positions.

Another specific object of the invention is to provide the disabling means with a shoulder on the plate-like member, and a slidable tab on the chassis. The tab has a rib slidable in front of the shoulder for disabling the rear bumper and plate-like member, and slidable out of the path of the shoulder for normal operation of the rear bumper and plate-like member between its first and second positions.

Another more specific object of the invention is to provide the vehicle with switch means for an electric motor thereon, comprising a first spring contact movable by a cam on a reciprocally movable actuator from a normal untensioned position to a tensioned position, and latched by movement of the ejector seat to its normal tensioned position. A second spring contact is provided having a normal untensioned position. The movable actuator is movable to a first position for engaging and moving the second spring contact from its normal untensioned position into engagement with a first spring contact for completing the electrical circuit to the electric motor; for driving the drive wheels. The ejector seat is adapted when moved to its ejecting position, to release the first spring contact for movement to its normal untensioned position, whereby the electrical circuit to the electric motor is interrupted and the motor ceases to run.

BRIEF DESCRIPTION OF THE DRAWINGS

In the detailed description of the invention presented below, reference is made to the accompanying drawings, in which.

DETAILED DESCRIPTION OF A PREFERRED EMBODIMENT

Because toy vehicles are well-known, the present description will be directed in particular to elements forming part of, or cooperating directly with, vehicle apparatus in accordance with the present invention. It is to be understood that elements not specifically shown or described may take various forms well-known to those skilled in the art.

Figure 1:
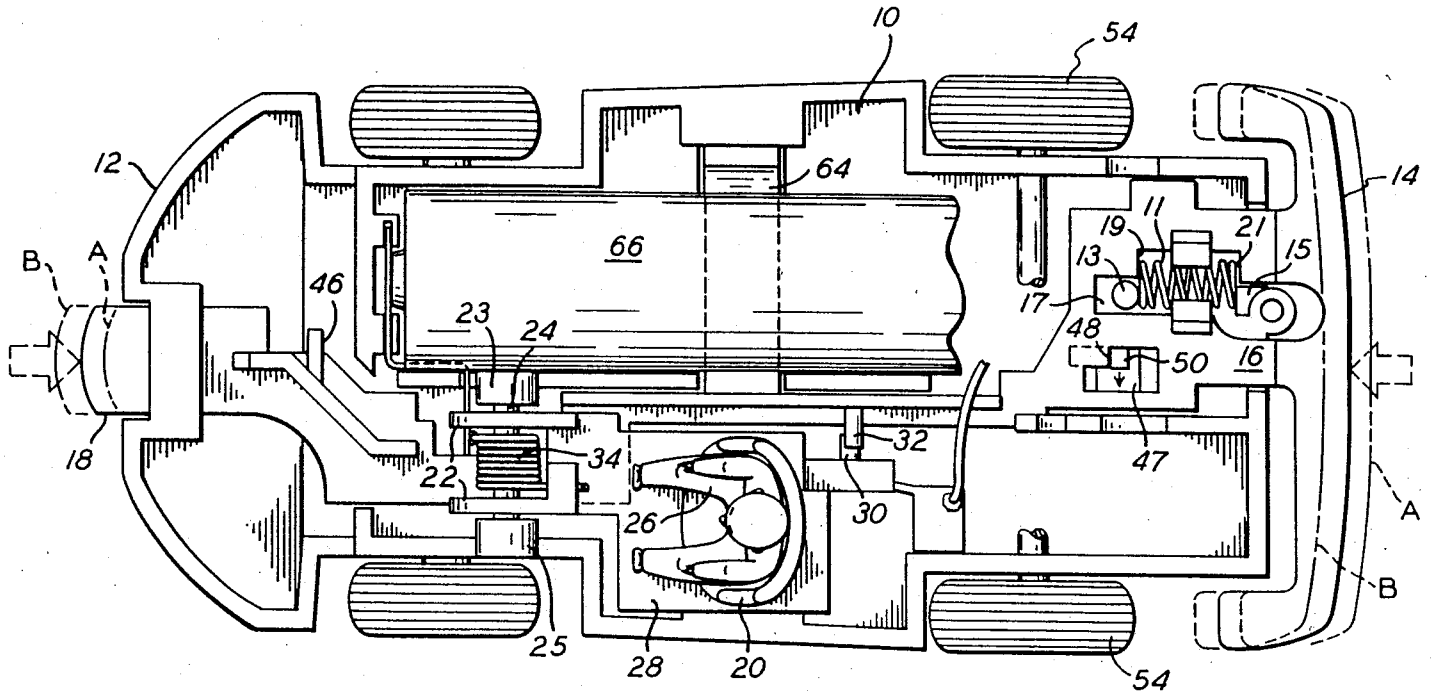
FIG. 1 is a top-plan view of a chassis of a toy simulated exploding vehicle in accordance with this invention partly broken away and with the motor removed to show the bumper spring mechanism and disabling lug.

With reference to FIG. 1, a chassis 10 for the toy vehicle of this invention is disclosed having a curved front end 12 which functions as a front bumper. The chassis 10 slidably supports a rear bumper 14 having an integral plate-like member 16 longitudinally extending from the bumper the length of the vehicle, with a free end 18 thereof extending past the front end 12 of the chassis 10. The rear bumper 14 and plate-like member 16 are slidable as a unit on the chassis 10 between a first position, shown dotted in FIG. 1 and designated A, and a second dotted position designated B. The plate-like member 16 is normally maintained in a position intermediate position A and position B by the combination of a spring 11 compressed between first and second posts 13 and 15, extending upwardly from chassis 10 through a generally T-shaped slot 17 formed in the plate-like member 16. The slot forms first and second shoulders 19 and 21 in the plate member 16. The shoulders are normally positioned adjacent posts 13 and 15 when the plate-like member is centered between positions A and B. When the plate-like member is displaced from its normally centered position, the spring is compressed, either between shoulder 19 and post 13, or between shoulder 21 and post 15 as the plate is moved towards positions A and B respectively. Thus, when the bumper is displaced and the plate moves to one of positions A and B, the spring will be compressed between one of the shoulders and one of the posts and will tend to return the bumper and the plate to the centered position.

If the front bumper 12 of the toy vehicle strikes an obstruction, the free end 18 of the plate-like member will also be struck, and the rear bumper and plate-like member will be moved to the position A. If, on the other hand, the toy vehicle is struck by a vehicle from the rear, the rear bumper is moved to position B.

The toy vehicle chassis 10 further supports an ejector seat 20 having a pair of arms 22 at one end thereof pivotally mounted to the chassis 10 by means of a pin 24 journaled between first and second chassis mounted bushings 23 and 25. The ejector seat 20 releasably supports a simulated driver 26 in a driving position. The ejector seat 20 comprises a pivotally mounted plate 28. The ejector seat plate 28 is held in a normal tensioned or cocked position against the bias of a spring 34 by the combination of a laterally extending lug 30 on the seat plate and a laterally extending ear 32 on the reciprocally movable plate-like member 16, that engages the lug when the plate 16 is in its normal undisturbed third position between positions A and B. When the rear or front bumper of the toy vehicle strikes an obstruction, movement of the rear bumper 14 and plate-like member 16 to either of positions A or B disengages ear 32 from lug 30 and releases the tensioned ejector seat 20, which pivots around pin 24 and ejects the driver 26 out of the vehicle.

There are situations in which the front end 12 of the vehicle is likely to inadvertently strike objects and it is desirable to prevent the vehicle from exploding, that is from having the front body member 38 (see FIG. 2) slammed open and the driver 26 catapulted from the seat. To achieve this, selective disabling means are provided to block movement of the rear bumper 14 and plate-like member 16 to position A when the front bumper 12 strikes an object. The disabling means comprise an L-shaped opening 47 having a shoulder 48 on the plate-like member 16 and a manually movable slidable tab 50 on the chassis 10. The front edge of the slidable tab 50 engages the rear edge of the shoulder 48 for blocking movement of the rear bumper 14 and plate-like member 16 to position A for preventing release of the ejector seat 28. Slidable movement of the tab 50 out of the path of the shoulder 48 (as indicated by the arrow in FIG. 1) allows normal movement of the rear bumper 14 and plate-like member 16 to its position A. Although the disabling means are shown for disabling the rear bumper 14 and plate-like member 16 when it is struck at the front end 12 of the vehicle, it is obvious that the disabling means could be reversed for disabling or preventing movement of the rear bumper and plate-like member to position B for preventing release of the ejector seat 28.

Figure 2:
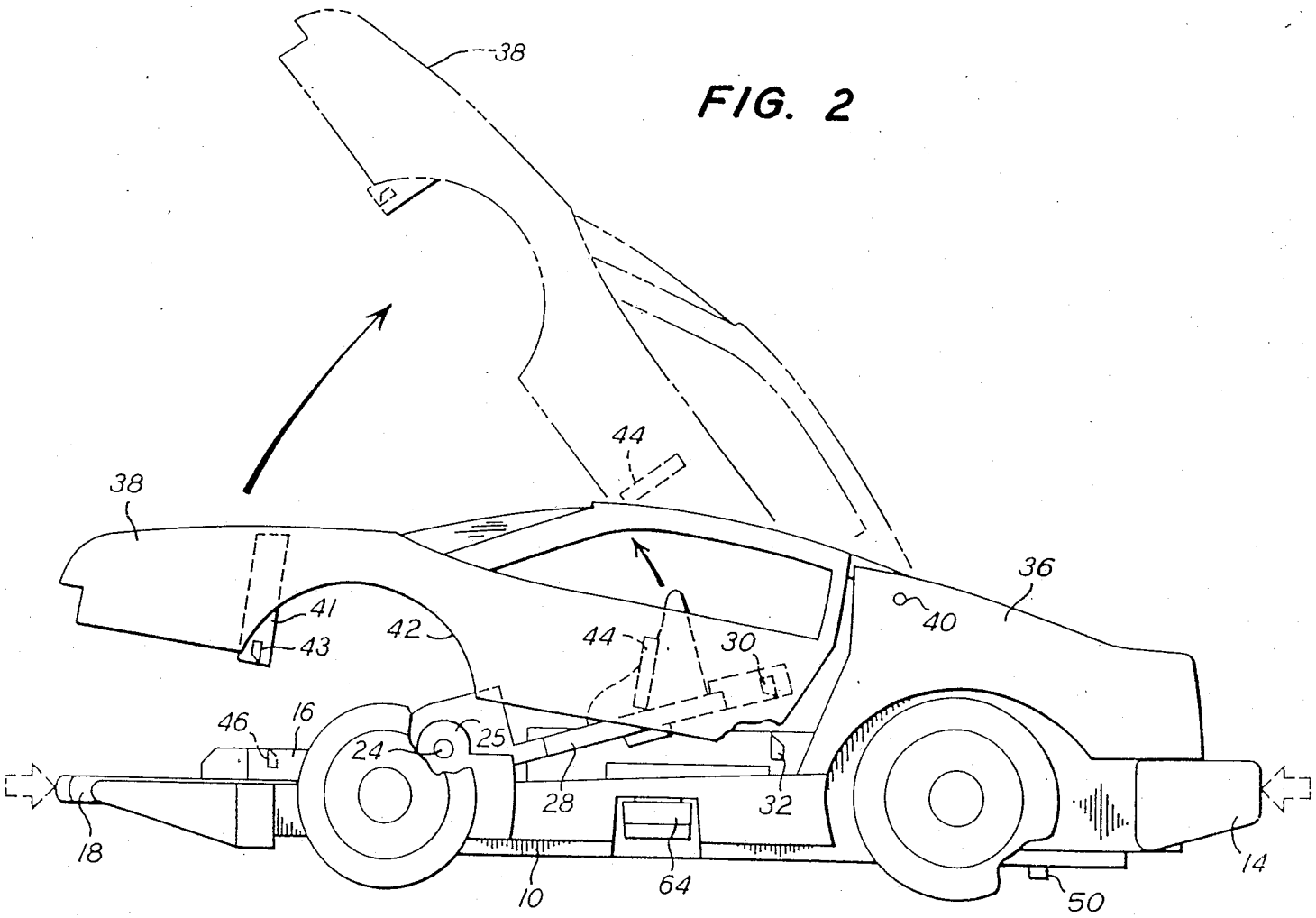
FIG. 2 is a side-elevational view of the vehicle of this invention, showing the ejector seat in its ejecting position, and the front body in its open position.

With reference to FIG. 2, a rear body member 36 is secured to the chassis 10 by any suitable means such as screws (not shown). A front body member 38 for the vehicle has one end thereof pivotally mounted on a pin 40 journaled in the rear body member 36 and the opposite end thereof releasably resting on the chassis. One of the side frame portions 42 of the front body member 38 is provided with a cam 44, which is adapted to be engaged by a side edge of the ejector seat plate 28, as it is moved to its ejecting position for slamming the front body member 38 into its open position, as seen in FIG. 2. At the same time, the driver 26 is catapulted from the ejector seat plate 28 through the opening between the front body member 38 and the front end of the chassis 10.

Preferably, the front body member 38 has a downwardly depending strut 41 having a laterally extending ear 43 thereon, preferably having a flat upper surface and a tapered lower portion as shown. Ear 43 engages a lug 46 on an upwardly reinforcing rib of plate-like member 16 for holding the front body member 38 in its normal closed position. When the plate-like member 16 is displaced to either of positions A or B, the lug 46 is disengaged from ear 43 allowing the front body member 38 to be slammed to its open position as described above.

Figure 3:
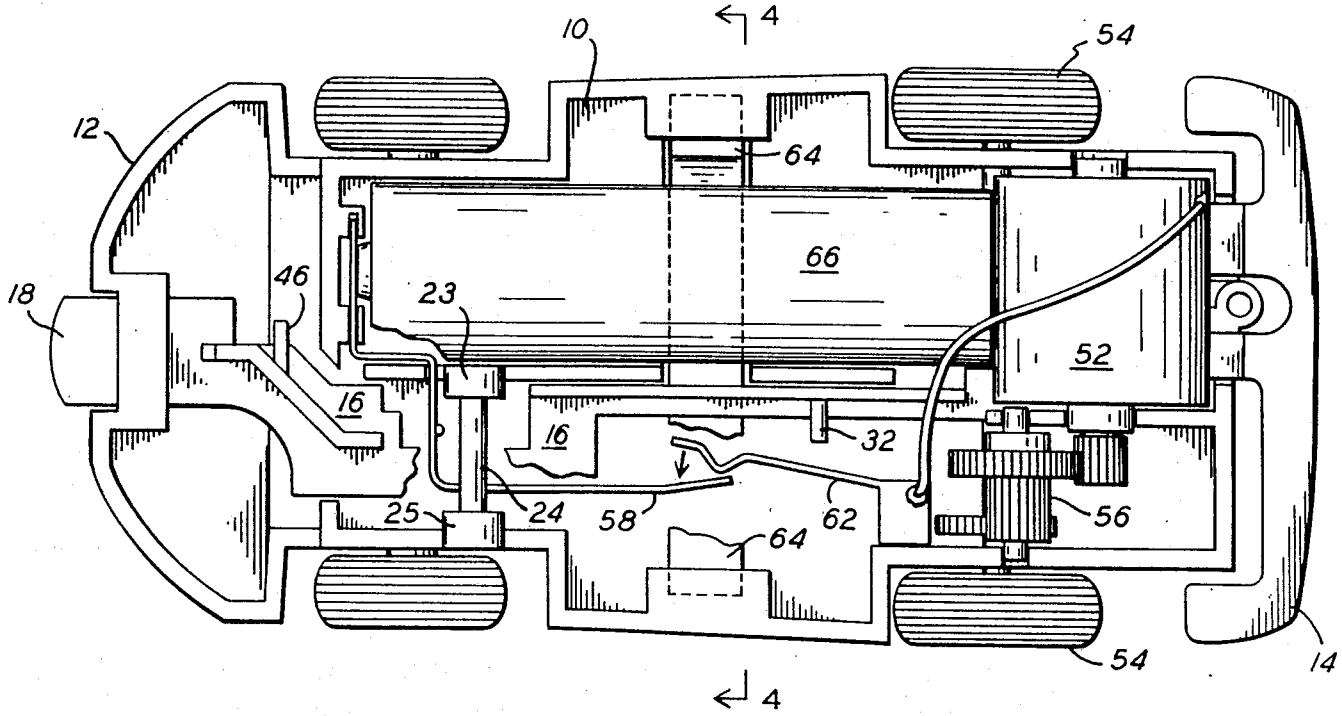
FIG. 3 is a top-plan view of the chassis of a toy exploding vehicle in accordance with this invention partly broken away to show the switch means for enabling and disabling the electric motor.
Figure 4:
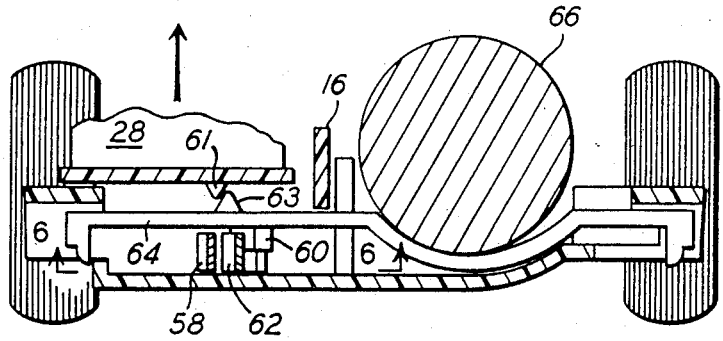
FIG. 4 is a section taken along line 4—4 of FIG. 3 showing the switch means for disabling the electric motor when the ejector seat is moved to its ejecting position.
Figure 5:
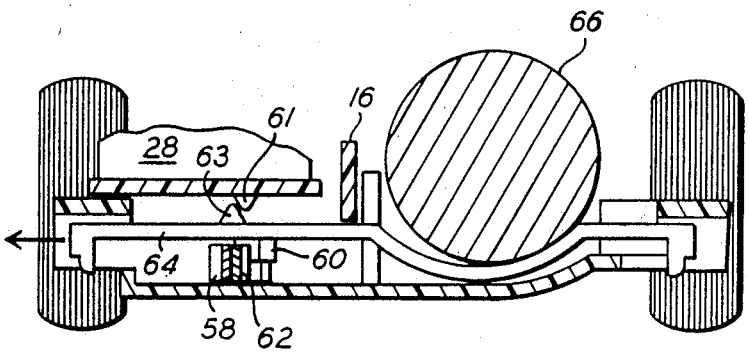
FIG. 5 is a section taken along line 4—4 of FIG. 3 showing the switch means in its enabled position.
Figure 6:
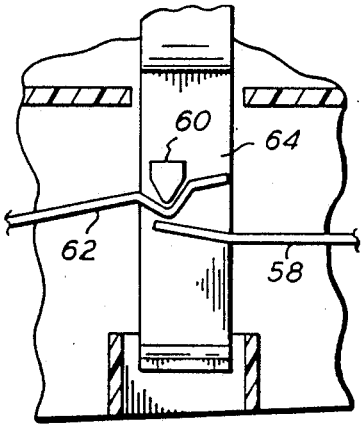
FIG. 6 is a fragmentary bottom plan view, partly in section taken along line 6—6 of FIG. 4 of the switch means for enabling/disabling the electric motor responsive to the position of the seat.

Referring to FIG. 3, a switch means is provided for actuating an electric motor 52 from a battery 66 having one terminal contacting the housing of motor 52 for driving the drive wheels 54 through a gear train 56, and for deactivating the motor 52 when the vehicle explodes and ejector seat 28 is released. The switch means comprises a first fixed leaf-spring contact 58 having a normal untensioned position. A second spring contact 62 is movable by a cam 60 (see FIG. 6) on the bottom surface of a reciprocally movable switch actuator 64 from a normal untensioned "off" position to a tensioned "on" position. The laterally extending reciprocally movable switch actuator 64 is supported by the chassis, and manually movable from its normal untensioned position as shown in FIG. 4 to an "on" position as shown in FIG. 5 for engaging and moving the second spring contact 62 into engagement with the first spring contact 58. This completes the electrical circuit from a battery 66 to the electric motor 52, for driving the drive wheels 54.

Ejector seat 28 is provided with a triangular shaped rib 61 projecting downwardly therefrom that engages a complementary shaped upwardly extending rib 63 on the switch actuator 64. Actuator 64 has a projecting lug 60, that engages rear contact 62 to hold it in electrical connection with front contact 58, where the switch actuator is in its on position as shown in FIG. 5. The facing flat surfaces of the two ribs hold the switch actuator in its on position as long as the ejector seat 28 is in its normal tensioned position. When the ejector seat moves upwardly as shown by the arrow in FIG. 4, rib 61 disengages from rib 63 and releases switch actuator 64, which is returned to its off position by rear contact 62, thus breaking the circuit and de-energizing the motor.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy simulated exploding vehicle comprising:

a chassis having a front end and a rear end;

an ejector seat mounted on the chassis and movable between a normal tensioned position in which it supports a simulated driver in a driving position, and an ejecting position in which it ejects the driver from the seat;

a rear bumper having a laterally extending plate-like member slidably mounted on the chassis for reciprocal movement of the rear bumper and plate-like member as a unit between first and second positions, the plate-like member having a free end thereof extending past the front end of the chassis; and latch means coupling the ejector seat to the plate-like member in a third position of the rear bumper and plate-like member between the first and second positions for releasably latching the ejector seat in its normal tensioned position, whereby movement of the rear bumper and plate-like member from the third position to one of the first and second positions releases the latch means for ejecting the driver.

2. A toy simulated exploding vehicle according to claim 1 wherein the ejector seat is pivotally mounted on the chassis.

3. A toy simulated exploding vehicle according to claim 2, and further comprising a front body releasably mounted on the chassis and having a cam member mounted on the inner surface of the front body, whereby movement of the ejector seat to its ejecting position causes a part of the ejector seat to strike the cam member and slam the front body to an open position as the driver is ejected between the chassis and front body.

4. A toy simulated exploding vehicle according to claim 3, wherein the front body is pivotally mounted to the chassis.

5. A toy simulated exploding vehicle according to claim 4, and further comprising front and rear wheels mounted on the chassis, and wherein the pivot for the ejector seat is located adjacent the front wheels and the pivot for the front body is located adjacent the rear wheels.

6. A toy simulated exploding vehicle according to claim 1, and further comprising disabling means for disabling the rear bumper and plate-like member, so that it cannot be moved to one of the first and second positions.

7. A toy simulated exploding vehicle according to claim 6 wherein the disabling means comprises a shoulder on the plate-like member and a slidable tab on the chassis having a lug slidable in front of the shoulder for disabling the rear bumper and plate-like member, and slidable out of the path of the shoulder for normal operation of the rear bumper and plate-like member between its first and second position.

8. A toy simulated exploding vehicle according to claim 1, and further comprising a drive wheel on the chassis, and an electric motor for driving the drive wheel, and switch means for the electric motor comprising a first spring contact movable from a normal untensioned position to a tensioned position, a second spring contact having a normal untensioned position, and a movable actuator movable to a first position for engaging and moving the second spring contact from its normal untensioned position into engagement with the first spring contact for completing the electrical circuit to the electric motor for driving the drive wheels, and wherein the ejector seat when moved to its ejecting position releases the first spring contact for movement to its normal untensioned position, whereby the electrical circuit to the electric motor is broken, and the motor ceases to run.

* * * * *